US010549870B2

(12) United States Patent
Luo et al.

(10) Patent No.: US 10,549,870 B2
(45) Date of Patent: Feb. 4, 2020

(54) WALKING TYPE WINDING MACHINE

(71) Applicant: HANGZHOU YOUNGSUN INTELLIGENT EQUIPMENT CO., LTD., Hangzhou, Zhejiang Province (CN)

(72) Inventors: Bangyi Luo, Hangzhou (CN); Caiqin Zhang, Hangzhou (CN); Leichun Wang, Hangzhou (CN); Ziquan Zhang, Hangzhou (CN); Xiaohui Zhou, Hangzhou (CN); Xiaomin Ding, Hangzhou (CN)

(73) Assignee: HANGZHOU YOUNGSUN INTELLIGENT EQUIPMENT CO., LTD., Hangzhou, Zhejiang Province (CN)

( * ) Notice: Subject to any disclaimer, the term of this patent is extended or adjusted under 35 U.S.C. 154(b) by 359 days.

(21) Appl. No.: 15/515,973

(22) PCT Filed: Oct. 15, 2015

(86) PCT No.: PCT/CN2015/091966
§ 371 (c)(1),
(2) Date: Mar. 30, 2017

(87) PCT Pub. No.: WO2016/066021
PCT Pub. Date: May 6, 2016

(65) Prior Publication Data

US 2018/0194503 A1 Jul. 12, 2018

(30) Foreign Application Priority Data

Oct. 28, 2014 (CN) ..... 2014 1 0586221
Oct. 28, 2014 (CN) ..... 2014 1 0586859
(Continued)

(51) Int. Cl.
*B65B 57/16* (2006.01)
*B65B 11/02* (2006.01)
(Continued)

(52) U.S. Cl.
CPC ..... *B65B 11/025* (2013.01); *B65B 11/02* (2013.01); *B65B 57/00* (2013.01); *B65B 57/08* (2013.01);
(Continued)

(58) Field of Classification Search
CPC ..... B65B 11/025; B65B 45/00; B65B 13/10; B65B 13/12; B65B 2210/16;
(Continued)

(56) References Cited

U.S. PATENT DOCUMENTS 1,625,505 A * 4/1927 Stump ..... B60R 16/005 200/61.44
4,067,174 A * 1/1978 Goldstein ..... B65B 11/025 53/210
(Continued)

FOREIGN PATENT DOCUMENTS

CN 103708049 A * 4/2014
CN 103708049 A 4/2014
(Continued)

*Primary Examiner* — Stephen F. Gerrity
*Assistant Examiner* — Joshua G Kotis
(74) *Attorney, Agent, or Firm* — Muncy, Geissler, Olds & Lowe, P.C.

(57) ABSTRACT

A walking type winding machine includes a front protection ring being fixed on a steering part and a steering counting device. The steering counting device includes a first sensor for sensing the steering of a machine body, and the first sensor is connected to a controller of the walking type winding machine. The steering part includes a second sensor which is supported by an elastic component such that the second sensor is movably installed on the steering part, and
(Continued)

the second sensor is used for sensing the backward movement of the frame of the steering part with respect to the second sensor. The walking type winding machine makes the control of a film winding path become simple and accurate, and it can protect important components of the steering part, improve walking steering sensitivity, and mitigate the impact on the machine body when colliding with an obstacle.

21 Claims, 8 Drawing Sheets

(30) Foreign Application Priority Data

Oct. 28, 2014 (CN) ..... 2014 2 0629777 U
Oct. 28, 2014 (CN) ..... 2014 2 0629855 U
Oct. 28, 2014 (CN) ..... 2014 2 0630267 U

(51) Int. Cl.
*B65B 59/04* (2006.01)
*B65B 57/08* (2006.01)
*B65B 57/00* (2006.01)
*B65B 11/04* (2006.01)
*B65B 13/12* (2006.01)

(52) U.S. Cl.
CPC ..... *B65B 57/16* (2013.01); *B65B 59/04* (2013.01); *B65B 11/04* (2013.01); *B65B 13/12* (2013.01)

(58) Field of Classification Search
CPC . B65B 2210/18; B65B 2210/20; B65B 67/08; B65B 67/085; B65B 57/16; B65B 57/02; B65B 57/04; B65B 57/08
USPC ..... 53/203, 210, 218, 461, 465, 588
See application file for complete search history.

(56) References Cited

U.S. PATENT DOCUMENTS 4,095,395 A 6/1978 Goldstein
4,631,898 A * 12/1986 Brambilla ..... B65B 11/025 180/169
6,148,942 A * 11/2000 Mackert, Sr. ..... B62B 9/00 180/65.6
8,033,348 B1 * 10/2011 Parkhe ..... B62B 9/00 180/19.1
2005/0021181 A1 * 1/2005 Kim ..... A47L 9/009 700/245
2007/0169442 A1 * 7/2007 Asioli ..... B65B 11/025 53/588
2008/0084284 A1 * 4/2008 Park ..... G05D 1/0227 340/436
2010/0289778 A1 * 11/2010 Felici ..... G05B 19/108 345/184
2010/0300049 A1 * 12/2010 Schmidt ..... B65B 11/025 53/461
2014/0053502 A1 * 2/2014 Pecchenini ..... B65B 11/025 53/218

FOREIGN PATENT DOCUMENTS

CN 104354889 A 2/2015
CN 104369892 A 2/2015
CN 204297150 U 4/2015
CN 204297154 U 4/2015
CN 204297219 U 4/2015
CN 204415787 U 6/2015
WO WO 2011057166 A2 5/2011

* cited by examiner

WALKING TYPE WINDING MACHINE

FIELD OF THE INVENTION

The present invention relates to a walking type winding machine.

BACKGROUND

Winding machine is a mechanical device in the field of packaging machinery, which is used to wrap packaging film on the surface of articles. The walking type winding machine is used for winding of articles with great volume. The walking type winding machine is a king of automatic equipment, including a steering part and a machine body. The walking type winding machine is provided with a front protection ring, which is fixed on the machine body, when the walking machine collides with an obstacle, it can protect the important parts of the steering part. However, when this structure collides with an obstacle, the machine body is directly impacted; moreover, the machine body has a large size, which is not sensitive to change direction when walking. In addition, for the previous walking type winding machines, the length of path is used to calculate the path, and the insensitive change of direction will bring great cumulative error.

SUMMARY

The first object of the present invention is to provide a walking type winding machine, which makes the control of a film winding path of a walking type winding machine become simple and accurate, and is not only able to protect important components of the steering part but also to improve walking steering sensitivity of a walking type winding machine, as well as to mitigate the impact on the machine body when colliding with an obstacle. To achieve this object, the present invention employs the following technical solutions:

A walking type winding machine, including a steering part and a machine body, the steering part is located at the front of the machine body, the walking type winding machine is provided with a front protection ring, and the machine body is provided with a drive wheel, wherein the front protection ring is fixed on a frame of a steering part; the walking type winding machine is provided with a steering counting device, and the steering counting device is provided with a first sensor for sensing the steering of a machine body, and the first sensor is connected to a controller of the walking type winding machine such that the controller can determine the steering times; and a second sensor is provided in the steering part, the second sensor or a component fixedly connected thereto is supported by an elastic component such that the second sensor is movably installed on steering part, and the second sensor is used for sensing the backward movement of the frame of the steering part or the component fixedly connected to the frame with respect to the second sensor.

On the basis of above technical solution, the present invention further employs the following technical solutions or a combination of the technical solutions thereof.

The steering counting device includes a mounting shaft in the steering part rotating synchronously with the steering part frame, a rotary part is mounted on the mounting shaft, and the rotary part has a sensed component connected to the mounting shaft by means of a friction fit, the steering counting device further includes a rotating limit structure of the rotating part, the rotary part is rotated synchronously with the mounting shaft under the friction provided by the friction fit, when rotated to collide with the limit structure, the rotary part is stopped by the limit structure, the mounting shaft can continue to rotate; the first sensor is fit with the sensed component.

The steering counting device includes a first part, a second part and a third part; the first part is a fixed part, mounted on the machine body, the first part includes a mounting rack, and the first sensor and the limit structure belong to the first part, the first sensor and the limit structure are mounted on the mounting rack; the mounting shaft is divided into an upper part and a lower part; the lower part of the mounting shaft belong to the second part, vertically fixed on the steering part frame; the upper part of the mounting shaft belongs to the third part, and third part is mounted on the second part through the fixed connection between the upper part of the mounting shaft and the lower part of the mounting shaft, the rotary part belongs to the third part, connected to the upper part of the mounting shaft by means of the friction fit.

The extension line of a mounting shaft in the steering part is vertically intersected with an axle of the steering part, the lower front side of the chassis of the machine body is in a step shape, and the front part of the machine body is overlaid at the rear part of the steering part through the step.

The first sensor and the limit structure have a position fit: when the rotary part collides with a limit structure in front of its rotation path, the sensed component can be sensed by the sensor.

The second sensor is located at the rear of the steering part.

The rear of the steering part has two symmetrical sensor mounting rack mounting areas with respective to the midline of the steering part, and the sensor mounting racks are mounted in the sensor mounting rack mounting areas, and the second sensor is mounted symmetrically on the two mounting racks with respective to the midline of the steering part.

The rear of the steering part has two symmetrical triangle areas or trapezoidal areas with respective to the midline of the steering part, the front of the sensor mounting rack is in fitted triangular or trapezoidal shape, and the sensor mounting racks are mounted in the triangle area or trapezoidal area, and the second sensor is mounted symmetrically on the two mounting racks with respective to the midline of the steering part.

The steering part is provided with a limit structure, and the limit structure is used to prevent the mounting rack from falling down and prevent excessive posterior displacement of the mounting rack.

The limit structure includes a limit hook, and the limit hook is hooked at the outer end of the mounting rack.

The manual brake operating mechanism includes a brake lever, and the brake lever is connected to a brake member of the brake mechanism via a connecting mechanism, to manually operate the brake member for braking and releasing brake.

The manual brake operating mechanism is further provided with a third sensor, and the third sensor is connected to a controller of a DC brake motor for transmitting the brake lever position information sensed to the controller.

A framework is fixed on the chassis in the front of the upright column, the upright column is until the bottom of the space at the back of the framework, and the machine body is further provided with a hinged connection structure at the height corresponding to the framework such that the upright column can be hinged at this height.

The drive motor on the upright column that drives the lifting is mounted on the top of the upright column and in front of the lifting guide rail. Further the drive motor includes a motor body and a reduction gear, and the reduction gear is located above the motor body.

The machine body chassis is provided with an insertion hole of a forklift arm, two insertion holes are provided at the front and back of the chassis. The insertion hole at the front side is close to the front end of the chassis, and the insertion hole at the back side is located at the part of the chassis in front of the upright column. Further, the lower front side of the chassis of the machine body is in a step shape, and the front part of the machine body is overlaid at the rear part of the steering part through the step; the insertion hole at the rear side is at the same height as the insertion hole at the front side.

The second object of the present invention is to provide a walking type winding machine, which makes the control of a film winding path become simple and accurate. To achieve this object, the invention employs the following technical solutions:

A walking type winding machine, including a steering part and a machine body, the steering part is located at the front of the machine body, wherein the walking type winding machine is provided with a steering counting device, and the steering counting device is provided with a first sensor for sensing the steering of a machine body, and the first sensor is connected to a controller of the walking type winding machine such that the controller can determine the steering times.

On the basis of above technical solution, the present invention further employs the following technical solutions or a combination of the technical solutions thereof.

The steering counting device includes a mounting shaft in the steering part rotating synchronously with the steering part frame, a rotary part is mounted on the mounting shaft, and the rotary part has a sensed component connected to the mounting shaft by means of a friction fit, the steering counting device further includes a rotating limit structure of the rotating part, the rotary part is rotated synchronously with the mounting shaft under the friction provided by the friction fit, when rotated to collide with the limit structure, the rotary part is stopped by the limit structure, the mounting shaft can continue to rotate; the first sensor is fit with the sensed component.

The steering counting device includes a first part, a second part and a third part; the first part is a fixed part, mounted on the machine body, the first part includes a mounting rack, and the first sensor and the limit structure belong to the first part, the first sensor and the limit structure are mounted on the mounting rack; the mounting shaft is divided into an upper part and a lower part; the lower part of the mounting shaft belong to the second part, vertically fixed on the steering part frame; the upper part of the mounting shaft belongs to the third part, and third part is mounted on the second part through the fixed connection between the upper part of the mounting shaft and the lower part of the mounting shaft, the rotary part belongs to the third part, connected to the upper part of the mounting shaft by means of the friction fit.

The extension line of a mounting shaft in the steering part is vertically intersected with an axle of the steering part, the lower front side of the chassis of the machine body is in a step shape, and the front part of the machine body is overlaid at the rear part of the steering part through the step.

The first sensor and the limit structure have a position fit: when the rotary part collides with a limit structure in front of its rotation path, the sensed component can be sensed by the first sensor.

The third object of the present invention is to provide a steering headstock of a walking type winding machine, which can not only protect important components of the steering part but also improve walking steering sensitivity of a walking type winding machine, as well as to mitigate the impact on the machine body when colliding with an obstacle. To achieve this object, the present invention employs the following technical solutions:

A steering headstock of a walking type winding machine, wherein the walking type winding machine including a steering part and a machine body, the steering part is located at the front of the machine body, the walking type winding machine is provided with a front protection ring, being fixed on a frame of the steering part.

On the basis of above technical solution, the present invention further employs the following technical solutions or a combination of the technical solutions thereof.

A second sensor is provided in the steering part, the second sensor or a component fixedly connected thereto is supported by an elastic component such that the second sensor is movably installed on steering part, and the second sensor is used for sensing the backward movement of the frame of the steering part or the component fixedly connected to the frame with respect to the second sensor.

The second sensor is located at the rear of a steering part.

The rear of the steering part has two symmetrical sensor mounting rack mounting areas with respective to the midline of the steering part, and the sensor mounting racks are mounted in the sensor mounting rack mounting areas, and the second sensor is mounted symmetrically on the two mounting racks with respective to the midline of the steering part.

The rear of the steering part has two symmetrical triangle areas or trapezoidal areas with respective to the midline of the steering part, the front of the sensor mounting rack is in fitted triangular or trapezoidal shape, and the sensor mounting racks are mounted in the triangle area or trapezoidal area, and the second sensor is mounted symmetrically on the two mounting racks with respective to the midline of the steering part.

The steering part is provided with a limit structure, and the limit structure is used to prevent the mounting rack from falling down and prevent excessive posterior displacement of the mounting rack.

The limit structure includes a limit hook, and the limit hook is hooked at the outer end of the mounting rack.

In the present invention, the steering counting device is combined to the steering part such that the walking type winding machine can accurately calculate the steering times. The travel distance is designed according to the number of corners of the wrapped articles, to ensure that the winding of package film is in place and easy to control; moreover, the front protection ring is fixed to the steering part, which can maintain the important functions of the front protection ring for important components of the steering part, reduce the length of the machine body, and enhance the walking steering sensitivity of a walking type winding machine, so that it is more accurate to determine the film winding path relying on the steering times; besides, the front protection ring is a part of steering part, which can turn and change to buffer when collided with an obstacle, the machine body will not be impacted, to mitigate the impact and shock on the whole machine. The sensor in the invention can sense the collision of the winding machine, to provide signals for timely braking of the winding machine and achieve automatic braking in case of collision. In addition, the present invention can achieve the following technical effects:

1. The steering counting device has a high sensitivity and it is easy to install.

2. It can achieve braking and release of braking of the walking type winding machine in power-on or power-off condition through the DC brake motor and manual brake; it is easy to operate and enhance the operating safety of the walking type winding machine.

3. The structure of the invention can facilitate the rotation and reversion of upright column during transportation, its structure is evenly arranged and the center of gravity is stable and reasonable, which can guarantee the walking performance and reduce the volume during transportation.

4. Through reasonable structural layout, it can enhance the design freedom of the operation panel to make it easy to operate, making reasonable and full use of the space of the control panel.

5. The invention does not affect the operating performance of various devices of the upright column; and the upright column shell can protect the drive motor and prevent the accidents occurring in the movement and transport process, to lower the center of gravity of the upright column to a certain extent and enhance the movement and transport safety.

6. The handling structure of the invention can adapt to the characteristics of walking type winding machine: great load on chassis, lifting film frame is arranged at the rear of the upright column, high asymmetry at the front and back, making the walking type winding machine easy to handle safely; in addition, the handling structure will not affect the film winding work, to lower the lifting film frame as much as possible and enhance the film winding effect.

DETAILED DESCRIPTION

Figure 1:
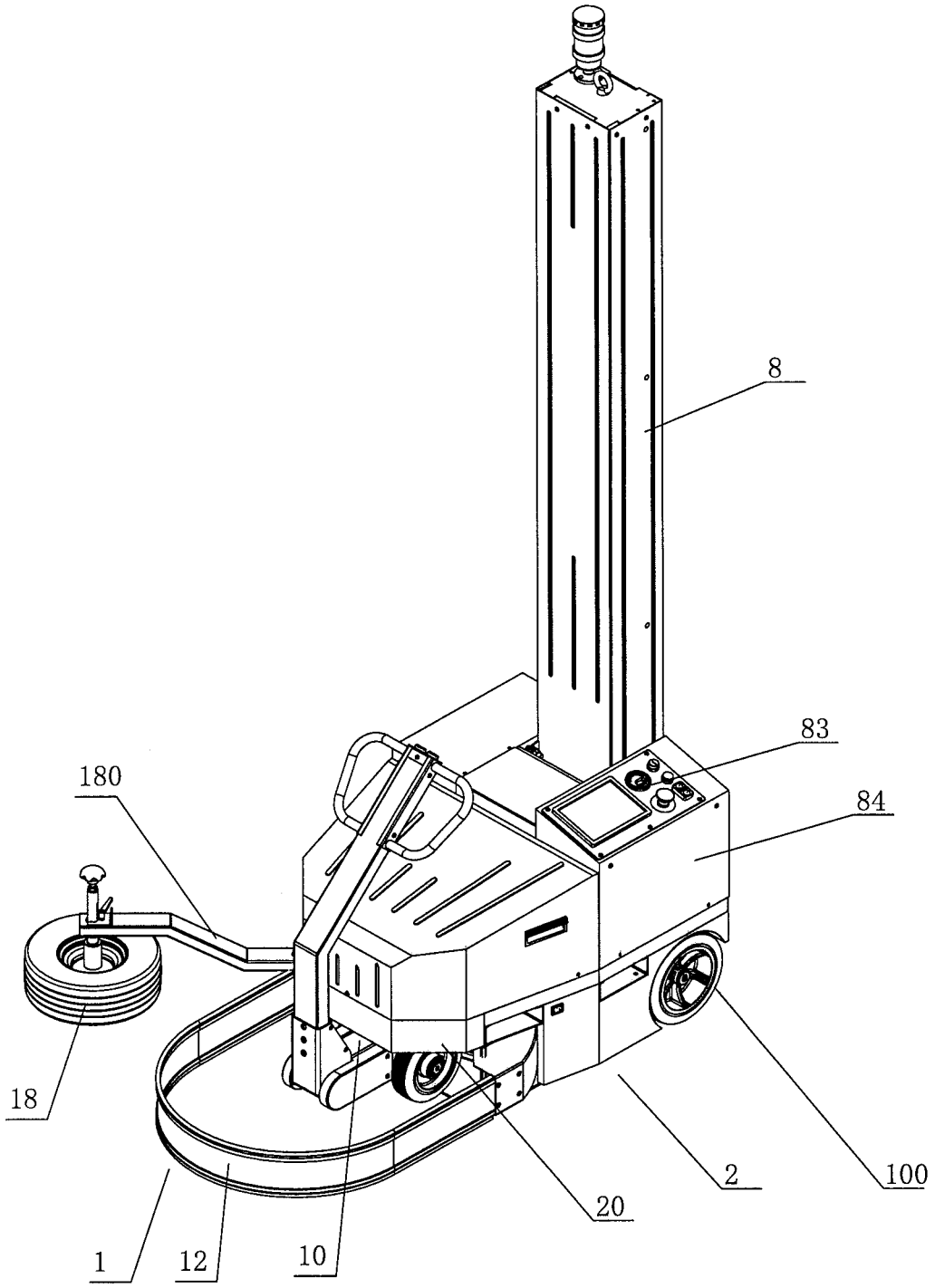
FIG. 1 is a schematic view of a walking type winding machine according to an embodiment in the invention.
Figure 2:
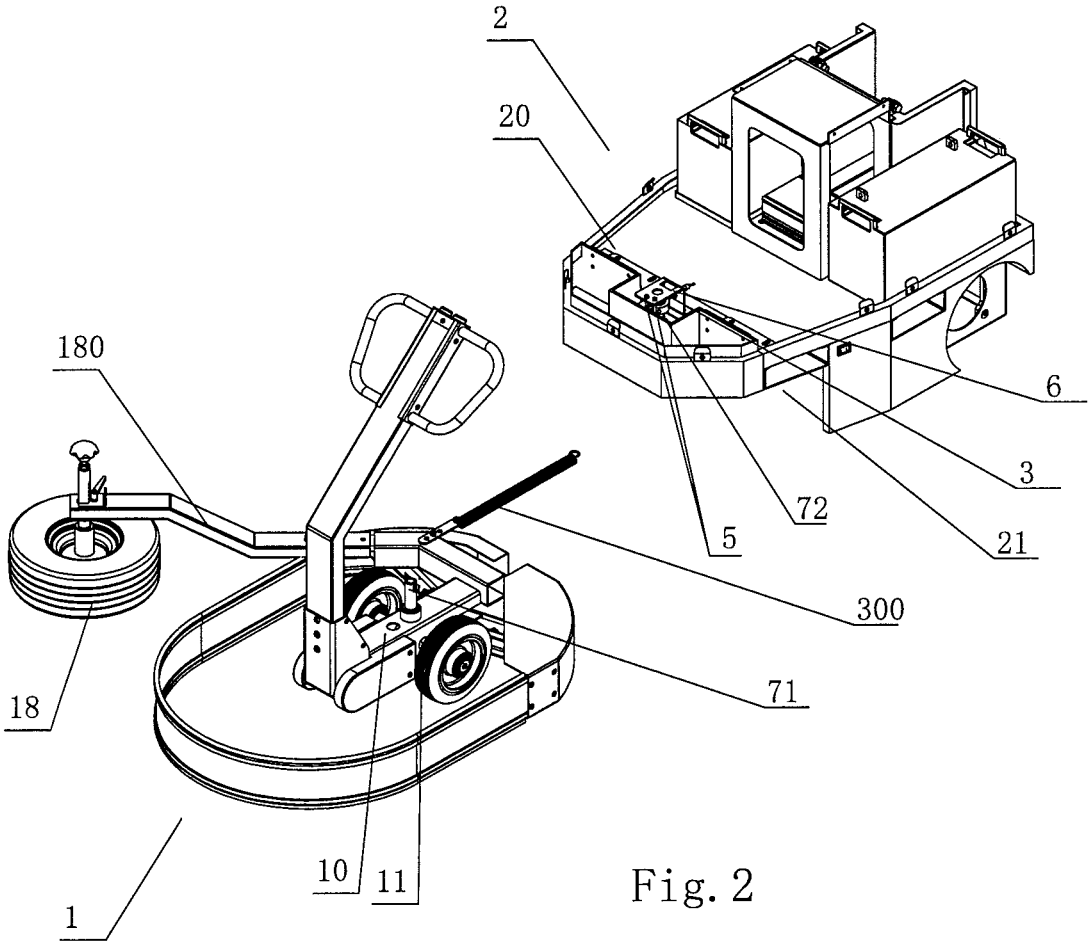
FIG. 2 is a matching schematic of a steering part and a machine body chassis according to an embodiment in FIG. 1.
Figure 3:
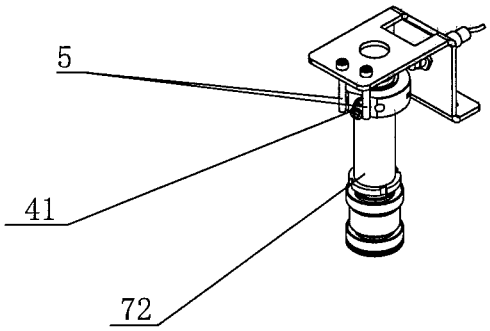
FIG. 3 is a schematic view of a third part of a counting device according to an embodiment in FIG. 1.
Figure 4:
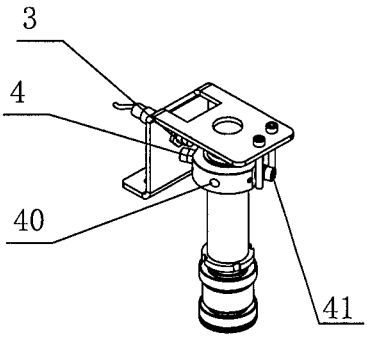
FIG. 4 is a schematic view of a third part of a counting device observed from another direction according to an embodiment in FIG. 1.
Figure 5:
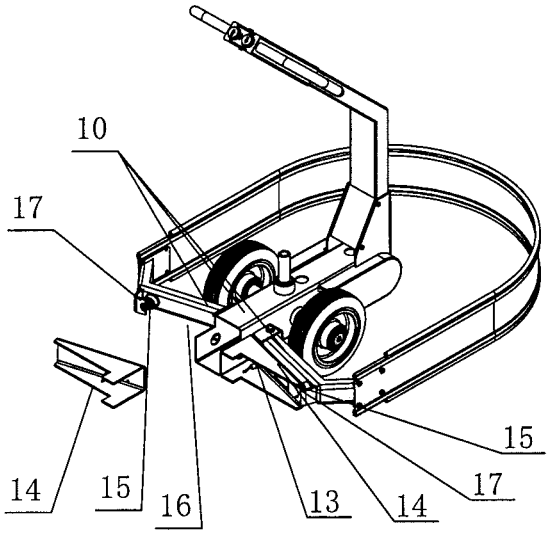
FIG. 5 is a schematic view of a steering part according to an embodiment in FIG. 1.
Figure 6:
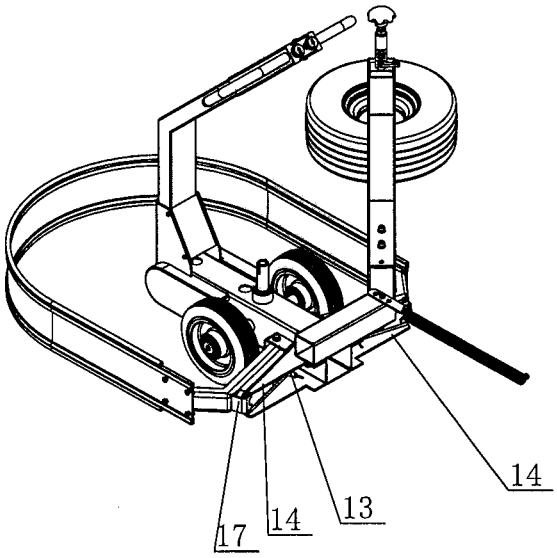
FIG. 6 is an exploded view of a steering part according to an embodiment in FIG. 1.
Figure 8:
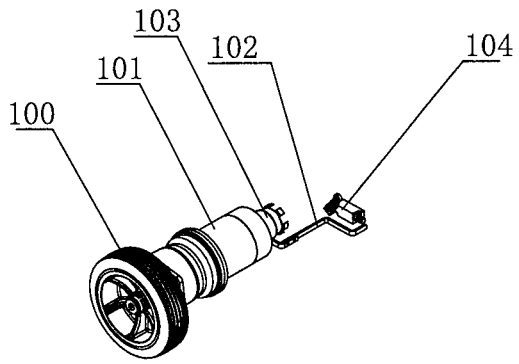
FIG. 8 is a schematic view of a drive wheel driven by a DC brake motor.
Figure 7:
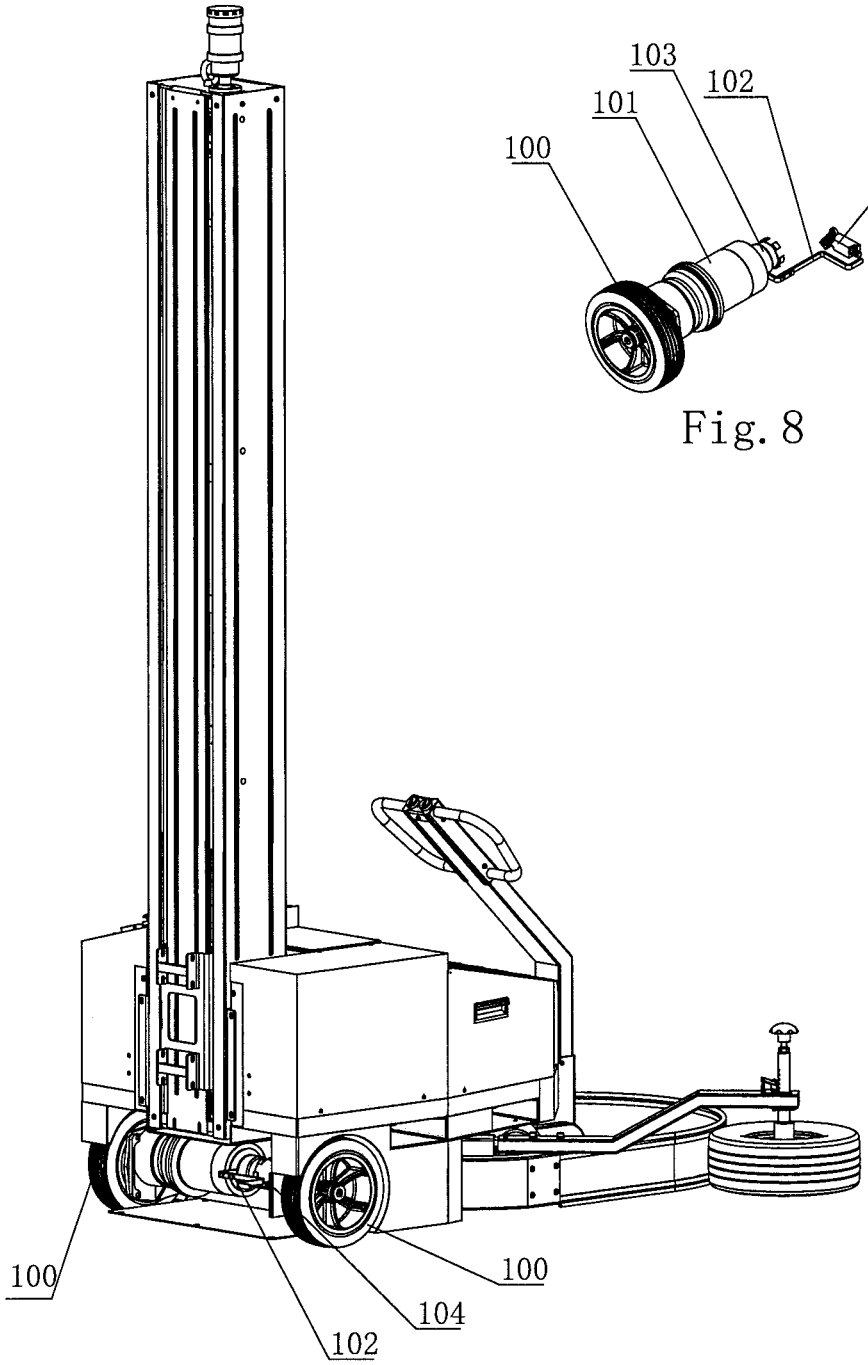
FIG. 7 is a schematic view of a walking type winding machine from another direction according to an embodiment in the invention.
Figure 9:
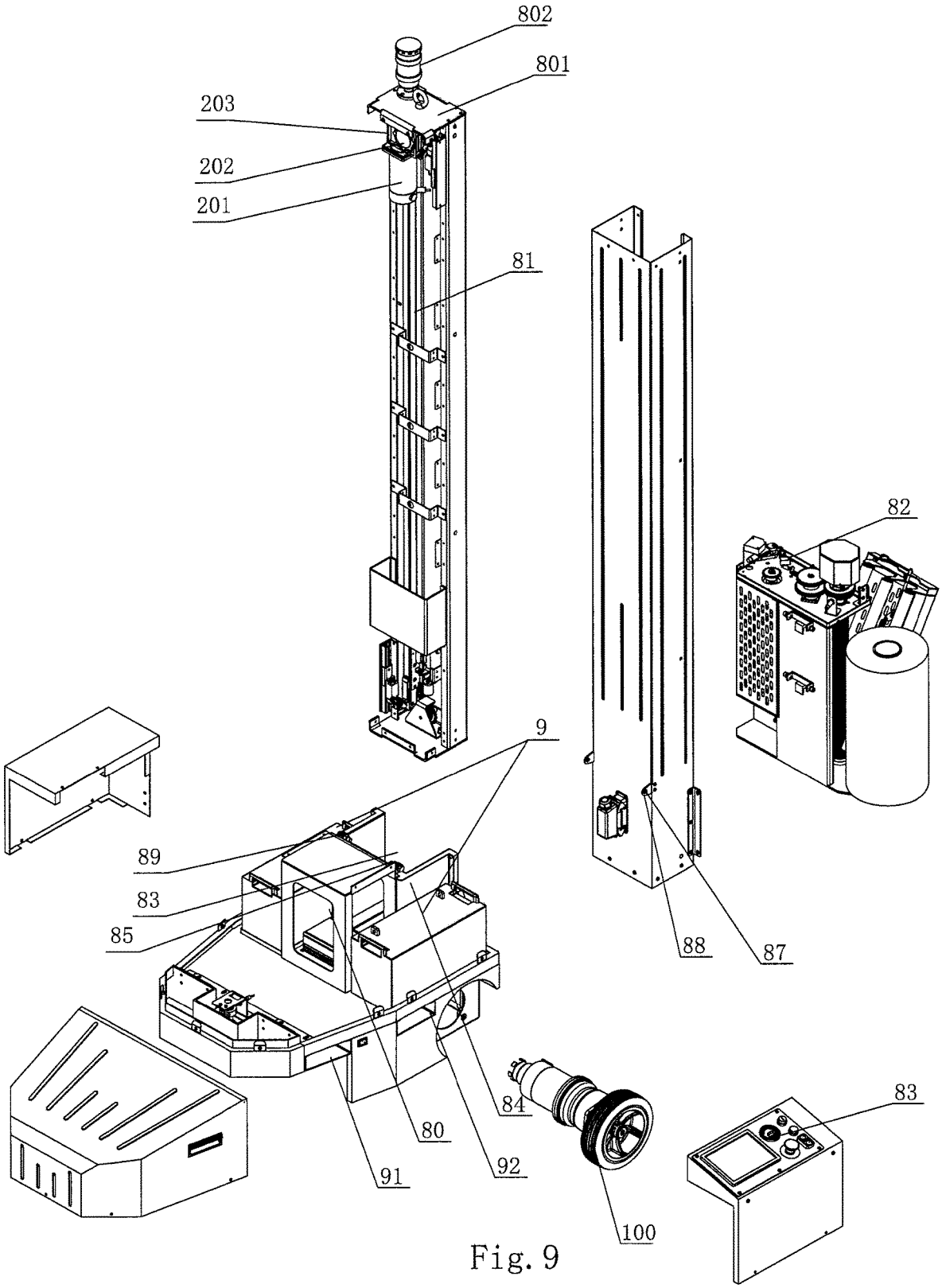
FIG. 9 is an exploded view of a machine body in FIG. 1.

Referring to figures, this invention provides a walking type winding machine, including a steering part and a machine body 2, the steering part is located at the front of the machine body; the functional devices of winding of the walking type winding machine are located in the machine body and mounted on the chassis 20 of the machine body. The machine body is provided with a drive wheel 100.

The walking type winding machine is provided with a steering counting device, and the steering counting device is provided with a first sensor 3 for sensing the steering of a machine body, and the first sensor 3 is connected to a controller of the walking type winding machine such that the controller can determine the steering times, to determine the film winding path.

The steering counting device includes a mounting shaft in the steering part 1 rotating synchronously with the steering part frame 10, a rotary part 40 is mounted on the mounting shaft, and the rotary part 40 has a sensed component 4 connected to the mounting shaft by means of a friction fit, the steering counting device further includes a rotating limit structure 5 of the rotating part 40, such as two limit pins, stoppers, etc., the rotary part 40 may have parts or protrusions 41 which are limited by them.

The rotary part 40 is rotated synchronously with the mounting shaft under the friction provided by the friction fit, when collided with the limit structure in the rotation path, the rotary part is stopped by the limit structure to stop rotation, the mounting shaft can continue to rotate; the first sensor 3 is fit with the sensed component 4, when the steering angle of the steering part (also the rotational angle of the sensed component 4) reaches the steering standard, the sensed component 4 can be sensed once by the first sensor 3. The first sensor 3 transmits the induced signal to the controller and accumulates it once; by this way, it can make the sensing part of the valve to become very sensitive, to facilitate precise film winding. The first sensor 3 and the limit structure 5 have the following position fit: when the sensed component rotates and collides with a limit structure in front of its rotation path (that is, the rotation angle reaches the rotation standard), it can be sensed by the sensor 3.

Further, this embodiment further provides a structurally reasonable and easy-to-install modular structure of steering counting device. The steering counting device includes a first part, a second part and a third part; the first part is a fixed part, mounted on the machine body, the first part includes a mounting rack 6, and the first sensor 3 and the limit structure 5 belong to the first part, the first sensor 3 and the limit structure 5 are mounted on the mounting rack 6; the mounting shaft is divided into an upper part and a lower part; the lower part 71 of the mounting shaft belong to the second part, fixed on the steering part frame 10; the upper part 72 of the mounting shaft belongs to the third part, and third part is mounted on the second part through the fixed connection between the upper part 72 of the mounting shaft and the lower part 71 of the mounting shaft, the rotary part 40 belongs to the third part, connected to the upper part 72 of the mounting shaft by means of the friction fit, for example, the rotary part 40 is provided with a friction sleeve which is sheathed on the upper part 72 of the mounting shaft with friction fit, or the rotary part 40 is provided with a bearing which is sheathed on the upper part 72 of the mounting shaft.

In order to make the steering counting device mounted in appropriate position of the steering part, for example, to make the extension line of a mounting shaft vertically intersected with an axle 11 of the steering part, the lower front side of the chassis of the machine body is in a step shape 21, and the front part of the machine body is overlaid at the rear part of the steering part through the step.

The walking type winding machine is provided with a front protection ring 12, which is fixed on a frame 10 of a steering part 1.

A second sensor 13 is provided in the steering part 1, the sensor mounting rack 14 is supported by an elastic component such that the second sensor is movably installed on steering part, the mounting rack 14 can be sheathed to pins, bolts fixed to frame 10 as a guide. The second sensor 13 is used for sensing the backward movement of the frame 10 of the steering part 1 or the component fixedly connected to the frame with respect to the second sensor 13. The elastic component can be a spring 15. The second sensor 13 is located at the rear of a steering part.

In order to further improve the sensitivity of sensing, the rear of the steering part 1 has two symmetrical sensor mounting rack mounting areas 16 with respective to the midline of the steering part, and the sensor mounting racks 14 are mounted in the mounting rack mounting areas 16, and the second sensor 13 is mounted symmetrically on the two mounting racks 14 with respective to the midline of the steering part.

The mounting rack mounting area 16 may be a triangle area, the front part of the mounting rack 14 is also in a matching triangular shape, so as to have an orientation and make the state of the mounting rack more stable.

The steering part is provided with a limit structure, and the limit structure is used to prevent the mounting rack 14 from falling down and prevent excessive posterior displacement of the mounting rack. The limit structure includes a limit hook 17, and the limit hook is hooked at the outer end of the mounting rack 14.

The drive wheel 100 is driven by a DC brake motor 101, and the brake mechanism of the DC brake motor is connected with a manual brake operating mechanism.

The manual brake operating mechanism includes a brake lever 102, and the brake lever 102 is connected to a brake member 103 of the brake mechanism via a connecting mechanism, to manually operate the brake member for braking and releasing brake. The manual brake operating mechanism is further provided with a third sensor 104, and the third sensor 104 is connected to a controller of a DC brake motor for transmitting the brake lever position information sensed to the controller, to prevent mistaken operation and prevent the walking type winding machine from starting a motor in the braking state.

The machine body 2 of the walking type winding machine further has an upright column 8 and a battery 9 used as a motor power source for the walking type winding machine. The battery 9 is arranged on both sides of the upright column 8, and a framework 80 is fixed on the chassis 20 in the front of the upright column 8, and electrical wiring and a battery charger and other equipment can be arranged in the framework 80. The space 83 until the bottom of the upright column 8 between the battery 9 on both sides and the front framework 80 can be connected with bolts or nuts at its bottom and chassis, and the machine body 2 is further provided with a hinged connection structure at the height corresponding to the framework 80 such that the upright column 8 can be hinged at this height.

The hinged connection structure can be arranged on the upright column 8 and the top of the framework 80. A bracket 84 connected to the chassis 20 or the framework 80 may be provided in the space 83. The hinged structure can be arranged on the upright column 8 and the top of the bracket 84.

The hinged connection structure is a bolt hole 87 and a bolt 85 which can pass through the bolt hole. The bolt hole can be provided on a connecting member 89 of the framework or the bracket and an engaging lug 88 of the upright column. During transportation, the upright column is rotated to fall on the framework using the bolt 85 as an axle, to reduce the transport volume.

The upright column is provided with a lifting body lifting guide rail 81, and the drive motor that drives the lifting of the lifting body 82 is mounted on the top of the upright column and is in front of the lifting guide rail 81, which can be protected by the upright column shell 800. The lifting body 82 includes a film rack.

The drive motor includes a motor body 201 and a reduction gear 202 which is above the motor body. The figure number 203 indicates a mounting rack of the drive motor, which is connected to the inside of the upright column shell 801 at the top.

On the basis of the above structure, the installation function on the outside of the upright column shell 801 at the top is optimized for idling, and an alarm lamp 802 that is simple and easy to disassemble can be provided, to further improve the walking safety of the walking type winding machine.

The walking type winding machine is further provided a sensing wheel 18, which is connected with the frame 10 of the steering part through its bracket 180. The steering part is connected to the machine body by a spring 300, and the spring 300 is connected between the frame 10 of the steering part (the bracket 180 is fixedly connected to the frame 10 and can be deemed a part of the frame) and the chassis of machine body.

In the left and right directions, the control panel 83 and the sensing wheel 18 of the walking type winding machine are located on different sides with respect to the upright column 8, the battery is located at both sides of the upright column respectively, the control panel 83 of the walking type winding machine is arranged at the top of the battery 9 on the walking type winding machine opposite to the sensing wheel 18.

Two insertion holes 91, 92 are provided at the front and back of the chassis. The insertion holes 91, 92 are opened at the side of the chassis 20. The insertion hole 91 at the front side is close to the front end of the chassis, and the insertion hole 92 at the back side is located at the part of the chassis 20 in front of the upright column 8.

The insertion hole 91 at the front side is located at the part of the chassis overlaid at the rear part of the steering part, and the insertion hole 92 at the rear side is at the same height as the insertion hole 91 at the front side. By this way, it can enhance the balance when handling and improve the handling safety.

Figure 10:
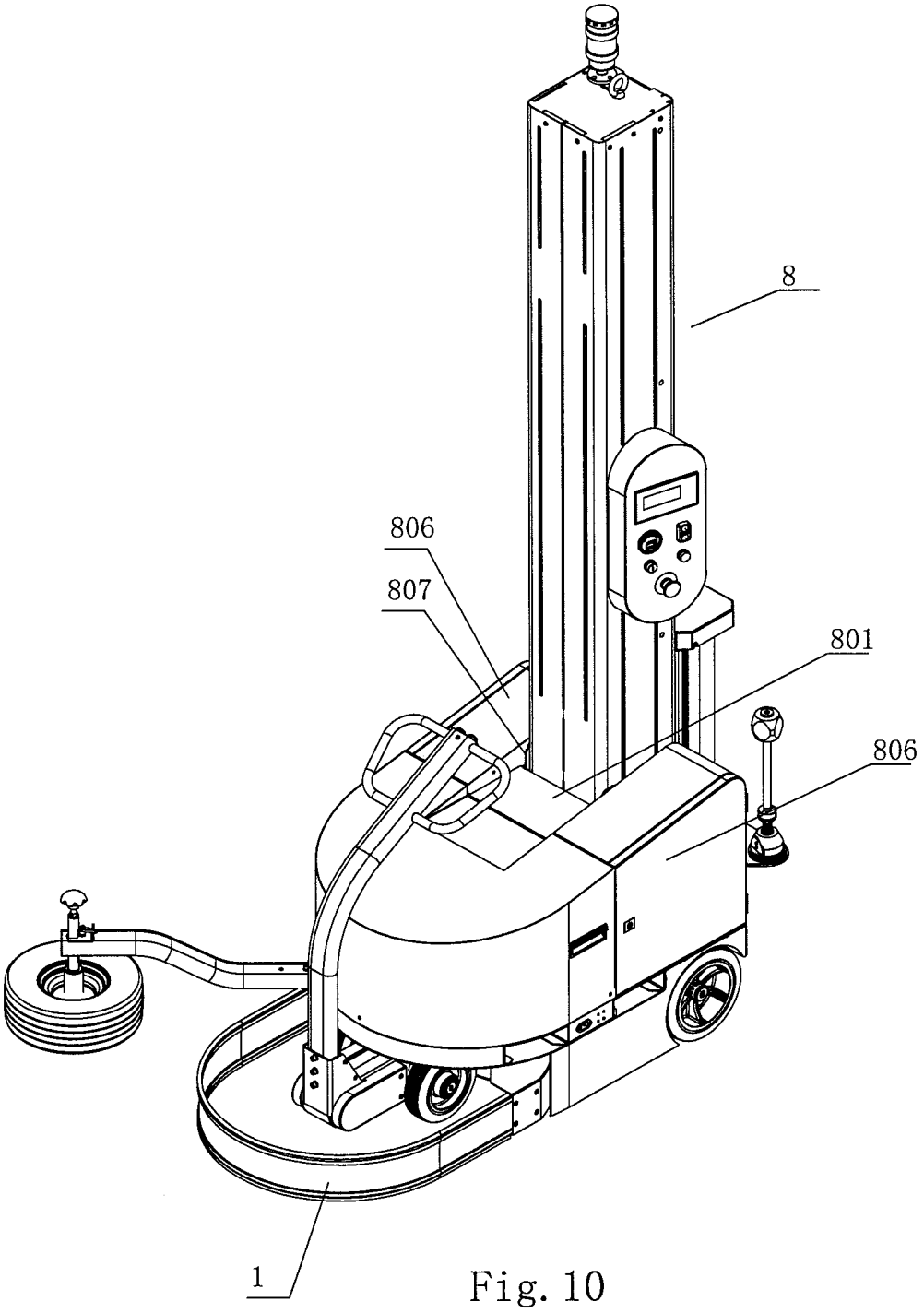
FIG. 10 is a perspective view of another rotary installation embodiment of an upright column of a walking type winding machine in the invention.
Figure 11:
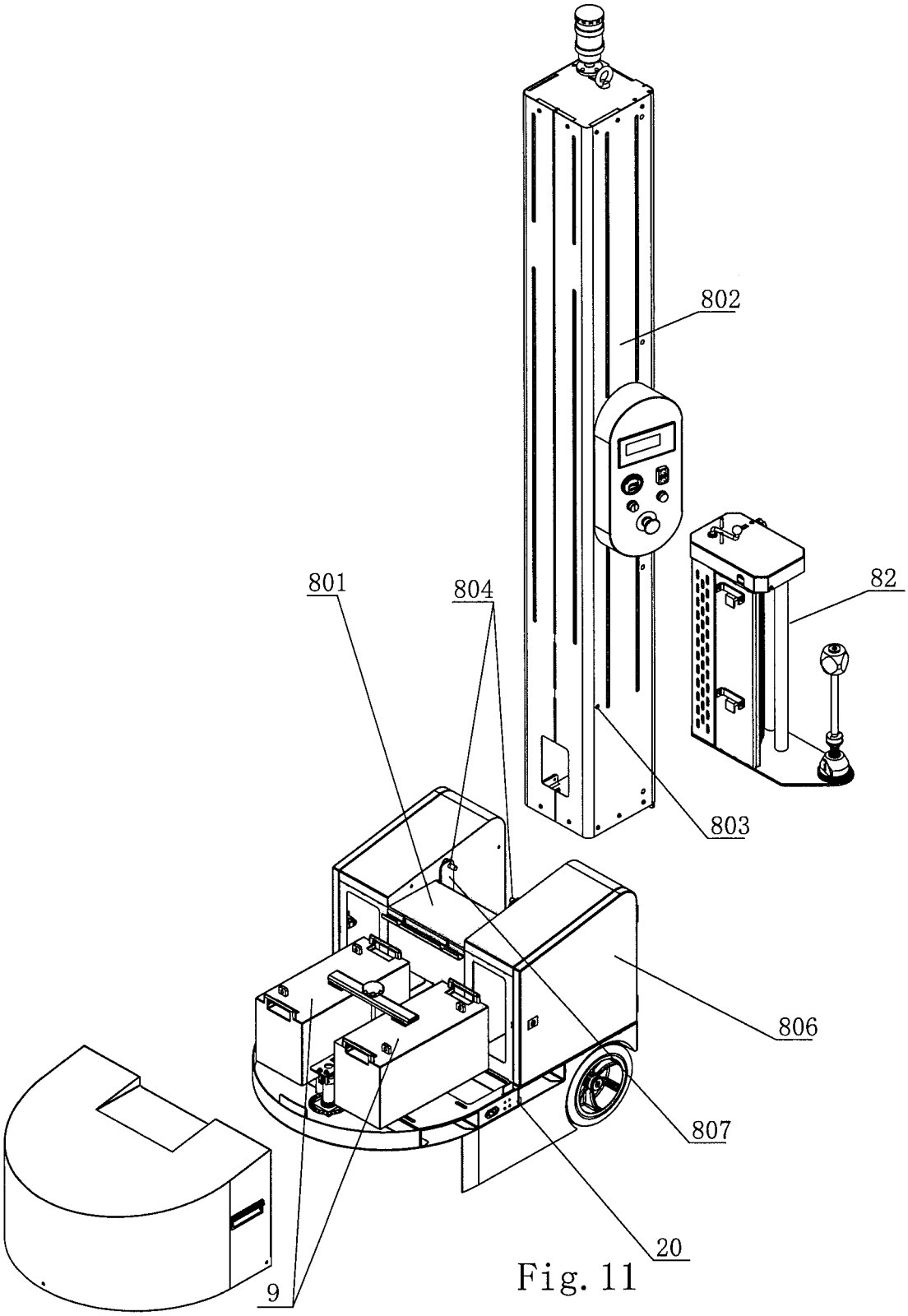
FIG. 11 is an exploded view of the embodiment shown in FIG. 10.
Figure 12:
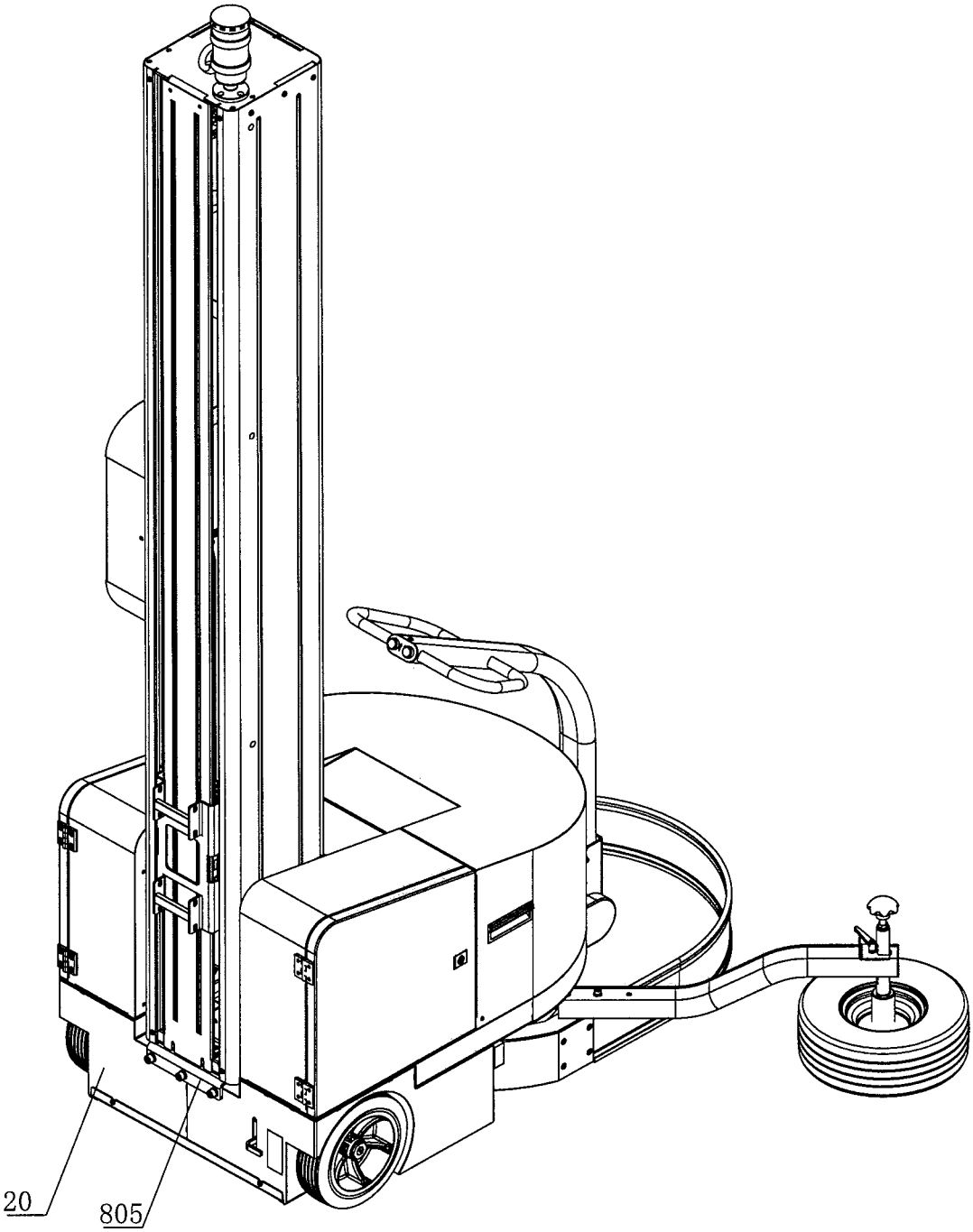
FIG. 12 is a perspective view of the embodiment shown in FIG. 19 from the rear side (the lifting film rack concealed).

Referring to FIGS. 10, 11, 12, a support frame 801 is fixed on the chassis in front of the upright column 8, the upright column is at the rear of the chassis 20; a connecting hole 803 is provided on lateral plates 802 at the both sides of upright column 8 in the height corresponding to the support frame, the upright column 8 is rotatably connected to the shaft 804 on both sides through the connecting hole 803 so that the upright column 8 can be retracted by the rotation on the support frame 801 during transport, and the upright column connection structure further includes an upright column vertical locking structure so that the upright column can lock its connection when rotated to a vertical position.

The upright column vertical locking structure includes a falling connecting plate 805 which is arranged at the bottom of the rear side of the upright column, and the falling connecting plate 805 is detachably connected with the chassis 20 through bolts.

A support rod 807 is provided at both sides of the upright column, the shaft 804 is mounted on the support rod 807, and the support rod 807 is fixed to the chassis 20.

A frame body 806 is provided on both sides of the upright column, and the frame body 806 is fixed to the chassis 20. The electrical wiring and a battery charger or other equipments are provided in the frame body, to facilitate maintenance and repair. The support rod 807 is located between the frame body 806 and the upright column 8.

A shaft sleeve of the shaft 804 can be provided in the upright column corresponding to the connection hole using the aforesaid way, so that the upright column is rotated more flexibly and stably.

In the utility model, the shaft 804 can be rotatably mounted, to facilitate the operations of rotation, reversion and erection of the upright column 8. A bearing can be provided on the shaft 804, then mounted to a fixedly mounted bearing seat which can be fixed to the frame body 806 or the support rod 807.

When transporting, the upright column 8 is rotated to fall on the support frame 801 using the pin 804 as a shaft, to reduce the transport volume.

The structure in this embodiment makes the operations of rotation, reversion and erection installation easy and conveniently. Besides, the connecting structure is simple, can save the installation space of the upright column, and after vertical installation, the upright column is securely fixed in stable state, and the wiring of the electrical equipment is reasonable to facilitate maintenance.

The foregoing description is merely a specific embodiment of the invention, which does not limit the structural features of the invention. Any changes or modifications made by those skilled in the art within the scope of the invention fall within the scope of protection of the present invention.

The invention claimed is:

1. A walking type winding machine, comprising:

a steering part and a machine body, wherein the steering part is located at a front of the machine body;

a front protection ring, wherein the front protection ring is fixed on a frame of the steering part;

a drive wheel provided with the machine body;

a controller;

a second sensor, wherein the second sensor is supported by an elastic component such that the second sensor is movably installed on the steering part, and the second sensor is used for sensing a backward movement of the frame of the steering part with respect to the second sensor; and a steering counting device, wherein the steering counting device comprises:

a first sensor connected to the controller, a mounting shaft, provided in the steering part, configured to rotate synchronously with the frame of the steering part, a rotary part mounted on the mounting shaft, and the rotary part comprising a sensed component connected to the mounting shaft by means of a friction fit, a rotating limit structure, wherein the rotary part is rotated synchronously with the mounting shaft under friction provided by the friction fit, wherein when rotated, the rotary part is configured to collide with the rotating limit structure and thereby be stopped by the rotating limit structure, wherein the mounting shaft can continue to rotate when the rotary part is stopped by the rotating limit structure, wherein the first sensor is configured to sense the sensed component when the rotary part collides with the rotating limit structure to indicate a steering time and transmit a signal to the controller, and wherein the controller receives the signal and is configured to determine a count of steering times.

2. The walking type winding machine according to claim 1, wherein the steering counting device comprises a first part, a second part and a third part; the first part is a fixed part, mounted on the machine body, the first part includes a mounting rack, and the first sensor and the rotating limit structure belong to the first part, the first sensor and the rotating limit structure are mounted on the mounting rack; the mounting shaft is divided into an upper part and a lower part; the lower part of the mounting shaft belong to the second part, vertically fixed on the steering part frame; the upper part of the mounting shaft belongs to the third part, and third part is mounted on the second part through a fixed connection between the upper part of the mounting shaft and the lower part of the mounting shaft, the rotary part belongs to the third part, connected to the upper part of the mounting shaft by means of the friction fit.

3. The walking type winding machine according to claim 2, wherein an extension line of the mounting shaft is substantially vertical and intersects with an axle of the steering part, wherein the axle is substantially horizontal.

4. The walking type winding machine according to claim 1, wherein an extension line of the mounting shaft is substantially vertical and intersects with an axle of the steering part, wherein the axle is substantially horizontal.

5. The walking type winding machine according to claim 1, wherein the first sensor and the rotating limit structure have a position fit, wherein when the rotary part collides with the rotating limit structure in front of its rotation path, the sensed component can be sensed by the first sensor.

6. The walking type winding machine according to claim 5, wherein the steering part is provided with a rack limit structure, and the rack limit structure is used to prevent the mounting rack from falling down and prevent excessive posterior displacement of the mounting rack.

7. The walking type winding machine according to claim 1, wherein the second sensor is located at the rear of the steering part; the rear of the steering part has two symmetrical sensor mounting rack mounting areas with respect to a midline of the steering part, and a plurality of sensor mounting racks mounted in the respective sensor mounting rack mounting areas.

8. The walking type winding machine according to claim 1, wherein the drive wheel is driven by a DC brake motor, the DC brake motor is controlled by the controller and the brake mechanism of the DC brake motor is connected with a manual brake operating mechanism.

9. The walking type winding machine according to claim 8, wherein the manual brake operating mechanism comprises a brake lever, and the brake lever is connected to a brake member of the brake mechanism via a connecting mechanism, to manually operate the brake member for braking and releasing brake.

10. A walking type winding machine, comprising a steering part and a machine body, the steering part is located at a front of the machine body;

a controller;

a steering counting device, and the steering counting device comprising:

a first sensor connected to the controller, a mounting shaft in the steering part rotating synchronously with a frame of the steering part, a rotary part mounted on the mounting shaft, the rotary part comprising a sensed component connected to the mounting shaft by means of a friction fit, wherein the rotary part is rotated synchronously with the mounting shaft under the friction provided by the friction fit, a rotating limit structure, wherein the rotary part is configured to collide with the rotating limit structure and thereby be stopped by the rotating limit structure, wherein the mounting shaft can continue to rotate when the rotary part is stopped by the rotating limit structure, wherein the first sensor is configured to sense the sensed component when the rotary part collides with the rotating limit structure to indicate a steering time and transmit a signal to the controller, and wherein the controller receives the signal and is configured to determine a count of steering times.

11. The walking type winding machine according to claim 10, wherein the steering counting device comprises a first part, a second part and a third part; the first part is a fixed part, mounted on the machine body, the first part includes a mounting rack, and the first sensor and the rotating limit structure belong to the first part, the first sensor and the rotating limit structure are mounted on the mounting rack; the mounting shaft is divided into an upper part and a lower part; the lower part of the mounting shaft belong to the second part, vertically fixed on the steering part frame; the upper part of the mounting shaft belongs to the third part, and third part is mounted on the second part through a fixed connection between the upper part of the mounting shaft and the lower part of the mounting shaft, the rotary part belongs to the third part, connected to the upper part of the mounting shaft by means of the friction fit.

12. The walking type winding machine according to claim 11, wherein an extension line of the mounting shaft is substantially vertical and intersects with an axle of the steering part, wherein the axle is substantially horizontal.

13. The walking type winding machine according to claim 10, wherein an extension line of the mounting shaft is substantially vertical and intersects with an axle of the steering part, wherein the axle is substantially horizontal.

14. The walking type winding machine according to claim 10, wherein the first sensor and the rotating limit structure have a position fit, when the rotary part collides with the rotating limit structure in front of its rotation path, the sensed component can be sensed by the first sensor.

15. A walking type winding machine, comprising:

a steering part and a machine body, the steering part is located at a front of the machine body;

a front protection ring fixed on a frame of the steering part;

a second sensor supported by an elastic component such that the second sensor is movably installed on the steering part, and the second sensor is used for sensing a backward movement of the frame of the steering part with respect to the second sensor;

a plurality of sensor mounting racks; and two symmetrical sensor mounting rack mounting areas with respect to a midline of the steering part;

wherein the sensor mounting racks are mounted on respective sensor mounting rack mounting areas and the second sensor is mounted on the sensor mounting racks.

16. The walking type winding machine according to claim 15, wherein the second sensor is located at the rear of the steering part.

17. The walking type winding machine according to claim 15, wherein a front of each of the sensor mounting racks are triangular or trapezoidal shaped, and the sensor mounting racks are mounted in triangle or trapezoidal areas of the sensor mounting rack mounting areas.

18. The walking type winding machine according to claim 17, wherein the steering part is provided with a limit structure, and the limit structure is used to prevent the mounting racks from falling down and prevent posterior displacement of the mounting racks.

19. The walking type winding machine according to claim 18, wherein the limit structure comprises a limit hook, and the limit hook is hooked at an outer end of the mounting racks.

20. The walking type winding machine according to claim 15, wherein the steering part is provided with a limit structure, and the limit structure is used to prevent the mounting rack from falling down and prevent posterior displacement of the mounting rack.

21. The walking type winding machine according to claim 20, wherein the limit structure comprises a limit hook, and the limit hook is hooked at an outer end of the mounting racks.

* * * * *